US008042806B2

(12) United States Patent
Ubayashi

(10) Patent No.: US 8,042,806 B2
(45) Date of Patent: Oct. 25, 2011

(54) IMAGE FORMING APPARATUS

(75) Inventor: Shinsuke Ubayashi, Kashiwa (JP)

(73) Assignee: Canon Kabushiki Kaisha (JP)

( * ) Notice: Subject to any disclaimer, the term of this patent is extended or adjusted under 35 U.S.C. 154(b) by 237 days.

(21) Appl. No.: 12/478,880

(22) Filed: Jun. 5, 2009

(65) Prior Publication Data

US 2009/0302528 A1 Dec. 10, 2009

(30) Foreign Application Priority Data

Jun. 6, 2008 (JP) ..... 2008-149465

(51) Int. Cl.
*B65H 9/14* (2006.01)

(52) U.S. Cl. ..... 271/229; 271/242; 271/258.02; 271/266; 271/270

(58) Field of Classification Search ..... 271/229, 271/242, 258.02, 266, 270; 399/372, 394, 399/395, 396
See application file for complete search history.

(56) References Cited

U.S. PATENT DOCUMENTS 7,751,771 B2 * 7/2010 Ubayashi ..... 399/395
2006/0051145 A1 * 3/2006 Ubayashi ..... 399/395
2007/0145677 A1 * 6/2007 Hancock ..... 271/270
2008/0211177 A1 * 9/2008 Obuchi et al. ..... 271/265.01
2008/0296836 A1 * 12/2008 Akiyama et al. ..... 271/242
2009/0218762 A1 * 9/2009 Terada ..... 271/266
2010/0014884 A1 * 1/2010 Roppongi ..... 399/82

FOREIGN PATENT DOCUMENTS

JP 2002-029649 A 1/2002

* cited by examiner

*Primary Examiner* — David H Bollinger
(74) *Attorney, Agent, or Firm* — Rossi, Kimms & McDowell LLP

(57) ABSTRACT

An image forming apparatus according to an exemplary embodiment of the invention includes a registration roller and a control portion. The registration roller is disposed on an upstream side of an image forming portion in a sheet conveying direction to convey a sheet to the image forming portion. The control portion controls to convey the sheet toward the registration roller at predetermined timing after temporarily stopping the sheet at a plurality of stop positions. The plurality of stop positions is set on an upstream side of the registration roller in the sheet conveying direction. The control portion conveys the sheet at predetermined timing from one of the plurality of stop positions when the plurality of sheets is continuously conveyed to the image forming portion. One of the plurality of stop positions does not become continuously identical.

5 Claims, 7 Drawing Sheets

IMAGE FORMING APPARATUS

BACKGROUND OF THE INVENTION

1. Field of the Invention

The present invention relates to an image forming apparatus that can improve throughput of a sheet without enlarging a driving source when images are formed while the sheets are continuously conveyed.

2. Description of Related Art

Conventionally, in an image forming apparatus such as a copying machine, a printer, a facsimile, and a multi function peripheral thereof, sometimes a sheet feeding apparatus that stacks many sheets to separate and feed the sheet one by one can be attached as an option.

As illustrated in FIG. 5, in the sheet feeding apparatus, many sheets are stacked on a sheet stacking portion, and a feeding roller 100 and a separation roller 101 feed and separate the sheet one by one from the topmost sheet. The fed sheet is delivered to an image forming apparatus main body by pairs of conveying rollers 102, 103, 104, and 105, and an image forming portion 106 forms an image.

At this point, in the image forming apparatus main body, after the continuously-conveyed sheet is temporarily stopped, and the sheet is conveyed toward the image forming portion at predetermined timing, thereby performing an operation (hereinafter referred to as "pre-registration operation") for adjusting an interval between sheets. Therefore, rotation of the conveying roller 105 is temporarily stopped based on a time a sheet passing sensor 107 detects a leading end of the sheet.

Accordingly, the leading end of the sheet that is being nipped and conveyed by the conveying rollers 105 is stopped at a predetermined position on a conveying path, and the control is perform to start the rotation of the conveying roller 105 again after a predetermined time elapses.

In the sheet feeding apparatus that stacks a large number of sheets, the sheet leading end is not always located at the normal stack position. That is, the sheet that is returned to a large-capacity deck by the separation roller 101 and the sheet leading end is located near the feeding roller 100, and the sheet that is located near the feeding roller 100 are also fed. Therefore, a position of the sheet leading end is varied in starting the sheet feeding, and it is necessary to eliminate the variation in front of a registration roller 108 located immediately before the image forming portion (maximum assumed time variation TT).

Specifically, as illustrated in FIG. 6, after the sheet leading end is detected by the sheet passing sensor 107, the conveying roller 105 is temporarily stopped to fix a stop position of the sheet leading end at a time the sheet leading end reaches a predetermined position A on the conveying path. Then a time B (B=(distance C to registration roller 108)/(sheet conveying speed β of conveying roller 105 until sheet reaches registration roller 108)) at which the sheet leading end is expected to reach the registration roller 108 is computed. Therefore, the control is performed to restart the conveying roller 105.

At this point, the variation is canceled because the control is performed to restart the conveying roller 105 after a predetermined time TR (TT<TR) the maximum assumed time variation TT can sufficiently be absorbed.

Then the sheet reaches the registration roller 108 in the stopped state through a pre-registration roller 109, and the rotation of the registration roller 108 is started at a constant process speed α in synchronization with image formation timing, thereby delivering the sheet to the image forming portion to transfer toner image to the sheet.

When a plurality of sheets is continuously conveyed, the feeding of the sheets subsequent to the first sheet is started after a predetermined time elapses since the previous sheet is restarted from the conveying roller 105. This is because the collision of the leading end of the next sheet with a rear end of the previous sheet is prevented at a position (hereinafter referred to as "pre-registration position") A where the conveyed sheet is temporarily stopped when the sheet is conveyed to the image forming portion at predetermined timing.

Thus, in the conventional copying machine, the variation in sheet leading end position in the sheet feeding portion is removed by performing the pre-registration operation, and the sheet leading end position is fixed to stably deliver the sheet to the registration roller 108.

In cases where the sheet on the conveying path is temporarily stopped by the pre-registration operation, it is necessary that the next sheet catch up with the previous sheet. Therefore, the conveying speed β in the conveying path from the sheet feeding portion to the registration roller 108 is set faster than the sheet conveying speed (process speed α of registration roller 108) in the image forming portion (see Japanese Patent Application Laid-Open No. 2002-29649).

However, in the conventional image forming apparatus, when productivity of the image formation is improved, the interval between the sheets becomes the narrowest at the pre-registration position. In order to avoid the narrowest interval at the pre-registration position, it is necessary to enhance the sheet conveying speed β as illustrated in a sheet conveyance diagram of FIG. 7.

Therefore, it is necessary to enlarge a driving motor for driving each conveying roller, and it is necessary that a sliding portion for supporting each conveying roller withstand high rotation, which results in cost increase.

SUMMARY OF THE INVENTION

An object of the present invention, which was made of view of the above circumstances, is to provide an image forming apparatus that can convey the sheet without enlarging the driving source for driving the roller and the like while the interval of the sheets continuously conveyed to form the continuous images is narrowed.

In accordance with an aspect of the invention, an image forming apparatus includes an image forming portion that forms an image in the sheet; a registration portion that is disposed on an upstream side of the image forming portion in a sheet conveying direction to convey the sheet to the image forming portion in synchronization with an image forming operation; and a control portion that sets a plurality of stop positions on the upstream side of the registration portion in the sheet conveying direction, the sheet being stopped at the stop position, the control portion performing control to convey the sheet toward the registration portion at predetermined timing after the conveyed sheet is temporarily stopped at the stop position, wherein when the control portion controls to convey the sheets continuously at predetermined timing from the plurality of stop positions to the registration portion, the control portion controls to not stop at an identical stop position continuously.

In the present invention, the plurality of stop positions is provided to temporarily stop the conveyed sheet, so that the next sheet can be delivered at early timing. Accordingly, because the sheet interval can be narrowed, the sheet interval can be ensured without enhancing the sheet conveying speed.

Further features of the present invention will become apparent from the following description of exemplary embodiments (with reference to the attached drawings).

DESCRIPTION OF THE EMBODIMENTS

An image forming apparatus according to an exemplary embodiment of the present invention will be described below based on an example in which the image forming apparatus is applied to a copy machine.

[Entire Configuration of Image Forming Apparatus]

Figure 1:
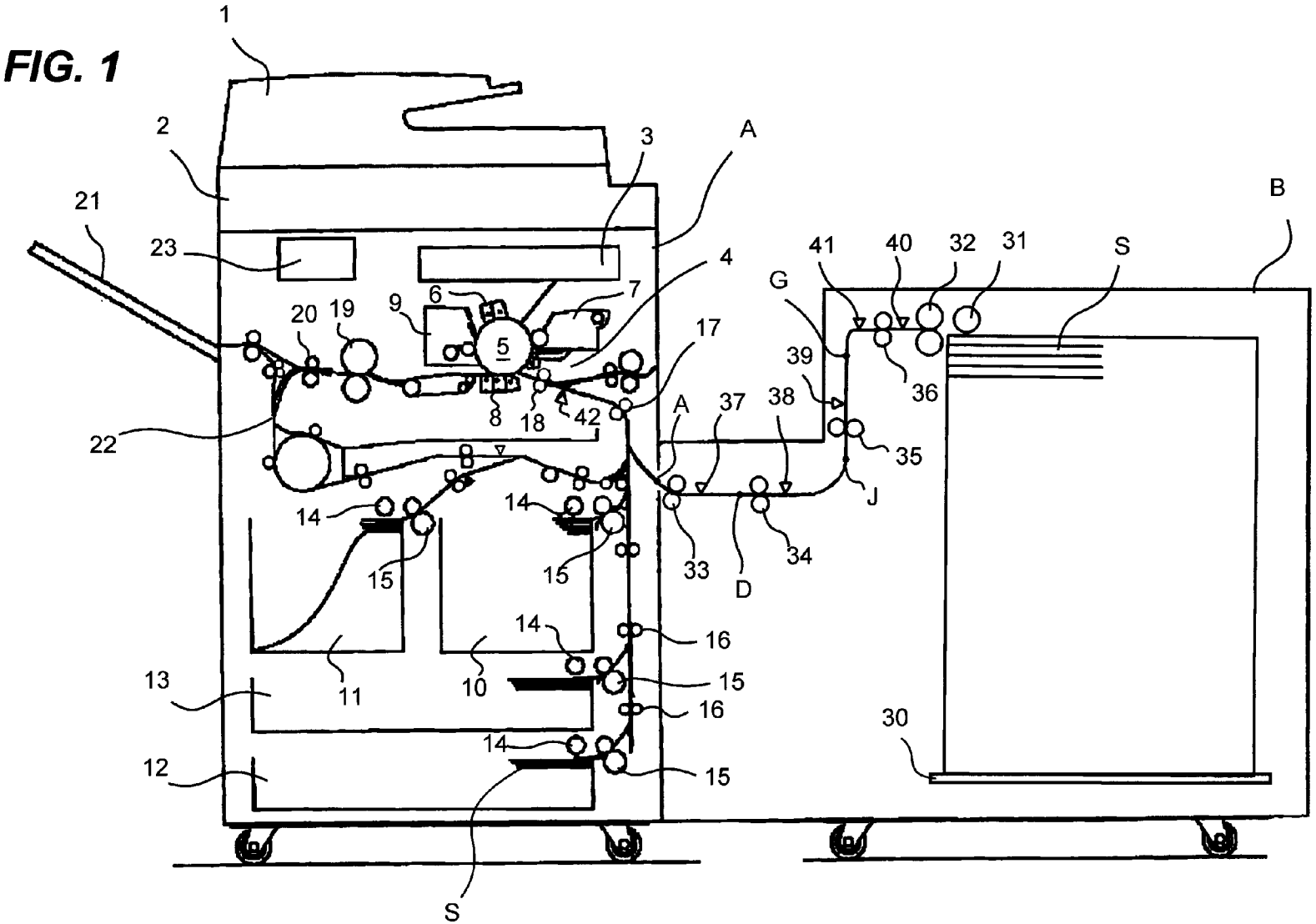
FIG. 1 illustrates a schematic configuration of a digital multi function copy machine according to an embodiment of the present invention.

An entire configuration of the image forming apparatus of the embodiment and an image forming operation will be described with reference to FIG. 1. In the image forming apparatus of FIG. 1, a sheet feeding apparatus B is attached as an option to an image forming apparatus main body A that forms an image on a sheet. The sheet feeding apparatus B is a large-capacity sheet deck that conveys the sheet to the image forming apparatus main body A.

(Image Forming Apparatus Main Body)

The image forming apparatus main body A is a copying machine that forms a toner image on the sheet by an electrophotographic system. An automatic original feeding apparatus 1 is disposed in a top portion of the apparatus main body. The automatic original feeding apparatus 1 conveys an original to a reading apparatus 2, and the reading apparatus 2 optically reads information on the original, and the reading apparatus 2 converts the information into a digital signal to transfer the digital signal to an exposure portion 3. An image forming portion 4 forms an image on the sheet based on the information.

In the image forming portion 4, a photosensitive drum 5 is rotatably provided, and a charger 6, a development device 7, a transfer charger 8, and a cleaning portion 9 are disposed around the photosensitive drum 5. The charger 6 charges the photosensitive drum 5. The development device 7 performs toner development of an electrostatic latent image. The transfer charger 8 applies a transfer bias in order to transfer the toner image on the photosensitive drum to the sheet. The cleaning portion 9 removes toner remaining on the photosensitive drum 5 after the toner image is transferred. In forming the image, the photosensitive drum 5 is rotated, and the photosensitive drum 5 that is evenly charged by the charger 6 is irradiated and scanned with a laser beam from the exposure portion 3 according to the image information, thereby forming the electrostatic latent image. The development device 7 performs the toner development of the electrostatic latent image to visualize the electrostatic latent image.

The sheet is conveyed to the image forming portion in synchronization with the image formation. Decks 10 and 11 and sheet cassettes 12 and 13, which are of a sheet feeding portion, are attached into a lower portion of the image forming apparatus main body A, and the sheets are loaded on the decks 10 and 11 and the sheet cassette 12 and 13. One of the decks 10 and 11 and sheet cassette 12 and 13 is selected in the image formation, and the sheet is separated and fed one by one from one of the decks 10 and 11 and sheet cassette 12 and 13 by a feeding roller 14 and a separation roller 15. A conveying roller 16 and a pre-registration roller 17 convey the fed sheet to a registration roller 18 that is stopped.

The registration roller 18 constitutes a registration portion that conveys the sheet to the image forming portion in synchronization with the image forming operation. A leading end of the sheet abuts on the registration roller 18 to form a loop, thereby correcting skew feeding of the sheet. Then the registration roller 18 is rotated to convey the sheet to the image forming portion 4 in synchronization with the image forming operation.

The toner image formed in the photosensitive drum 5 is transferred to the conveyed sheet by applying a bias to the transfer charger 8, the sheet is conveyed to a fixing device 19, and the fixing device 19 heats and pressurizes the sheet to fix the toner image to the sheet. A discharge roller 20 discharges the sheet, onto which the toner image is fixed, to a discharge tray 21. In cases where duplex printing is performed, the sheet in which the print is performed to a surface is conveyed to the image forming portion again through an inversion conveying path 22, the print is performed to the backside of the sheet, and the sheet is discharged to the discharge tray 21.

(Sheet Feeding Apparatus)

In the copying machine of the embodiment, the sheet feeding apparatus B that feeds the sheet to the image forming portion 4 is attached to the apparatus main body A. In the sheet feeding apparatus B, many sheets S are stacked on a stack stage 30 that can be lifted and lowered. The stack stage 30 is lifted and lowered such that a top surface of the stacked sheets is always kept constant.

A feeding roller 31 feeds the sheets stacked on the stack stage 30 from the topmost sheet, and a separation roller 32 separates the sheet one by one. A plurality of pairs of conveying rollers constituting a sheet feeding portion is disposed on the conveying path of the sheet conveyed to the image forming portion 4 and on an upstream side in the sheet conveying direction (hereinafter simply referred to as "upstream side") of the registration roller 18. In the embodiment, a first conveying roller 33, a second conveying roller 34, a third conveying roller 35, and a fourth conveying roller 36 are sequentially provided from a downstream side in the sheet conveying direction (hereinafter simply referred to as "downstream side") toward the upstream side. The conveying rollers 33, 34, 35, and 36 are used in a pre-registration operation. In the pre-registration operation, the conveying rollers 33, 34, 35, and 36 are rotated at predetermined timing and stop the rotation to stop the conveyed sheet, and the conveying rollers 33, 34, 35, and 36 convey the sheet toward the registration roller 18 at predetermined timing. That is, in the embodiment, a plurality of stop positions is provided in order that the conveyed sheet is stopped to perform the pre-registration operation.

Sheet passing sensors 37, 38, 39, and 40 are disposed in the neighborhood on the upstream side of each of the conveying rollers 33, 34, 35, and 36 in order to detect the leading end and rear end of the conveyed sheet. A sheet passing sensor 41 is also disposed in the neighborhood on the downstream side of the fourth conveying roller 36. A registration sensor 42 is also disposed in the neighborhood on the upstream side of the registration roller 18 in order to detect the leading end of the sheet.

A driving force of a driving motor (not illustrated) is transmitted to rotate each of the rollers. A control portion 23 controls the rotation of each of the rollers based on the detection results of the sheet passing sensors 37, 38, 39, 40, 41, and 42.

[Sheet Conveying Operation]

An operation in which the sheet feeding apparatus B feeds the sheet to the image forming portion 4 will be described.

When the plurality of sheets is continuously conveyed to the image forming portion 4, the control portion 23 conveys the sheet at predetermined timing to the registration roller 18 from one of the plurality of stop positions according to a sheet size. One of the stop positions is selected so as not to become continuously identical.

A specific example will be described below. At this point, the conveyed sheets are divided into three kinds of sizes including a small size, a normal size, and a large size. That is, the cases in which B5-size, A4-size, and A3-size sheets are conveyed will be described by way of example.

(B5 Size)

Figure 2:
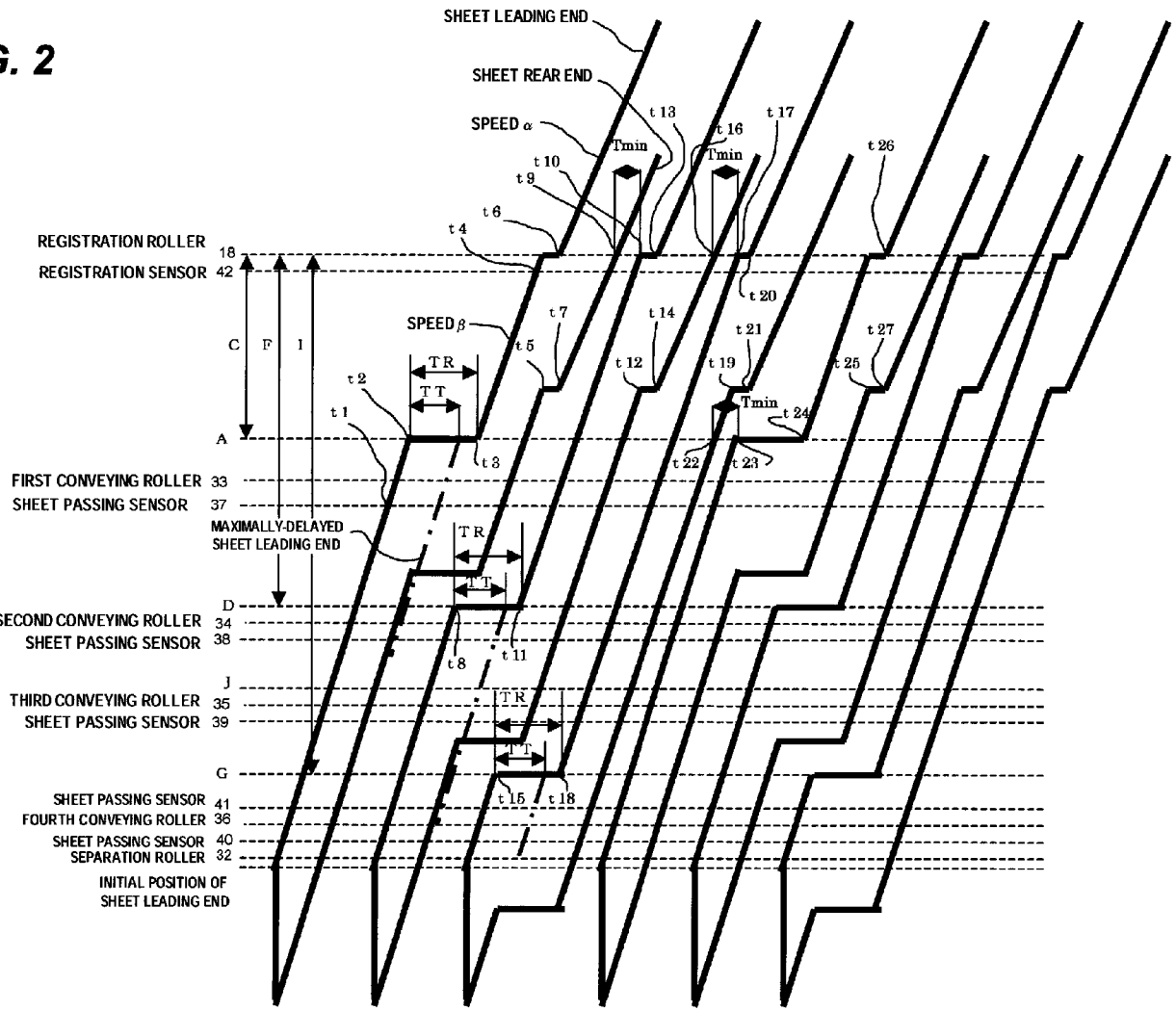
FIG. 2 is a diagram of B5-size sheet conveyance.

In cases where the B5-size (length of 182 mm) sheets are continuously conveyed, as illustrated by a diagram of FIG. 2, the B5-size sheet is temporarily stopped, and the B5-size sheet is conveyed at predetermined timing. FIG. 2 is the diagram illustrating the leading end and the rear end when the sheets are continuously fed.

At the beginning of the continuous sheet feeding from the sheet feeding apparatus B, the driving motor rotates the feeding roller 31, the separation roller 32, the fourth conveying roller 36, the third conveying roller 35, the second conveying roller 34, and the first conveying roller 33. At this point, the pre-registration roller 17 and the registration roller 18 are still in the stopped state.

The feeding roller 31 delivers the sheets S set in the stack stage 30 to the separation roller 32 including a roller pair of a feed roller and a retard roller. Only the topmost sheet is separated from the sheets S set in the stack stage 30 using the retard roller. The retard roller is provided while facing the feed roller, and a torque for rotating the retard roller in an opposite direction to the sheet conveying direction is given to the retard roller.

The topmost sheet separated from the stacked sheets is directly conveyed to the sheet passing sensor 37, and the sheet passing sensor 37 detects the leading end of the sheet (time t1). The sheet is delivered to the first conveying roller 33 that is disposed in the neighborhood on the downstream side of the sheet passing sensor 37, and the first conveying roller 33 conveys the sheet by the following pre-registration operation.

The control portion 23 performs control to temporarily stop the rotation of the first conveying roller 33 at a time t2 the sheet leading end reaches a predetermined position (pre-registration position) A on the downstream side of the sheet passing sensor 37. Therefore, the stop position of the sheet leading end is fixed to remove a variation in sheet leading end position (maximum assumed time variation TT) in starting the feeding of the sheet from the large-capacity sheet deck.

After a predetermined time TR (TT<TR) the maximum assumed time variation TT can sufficiently be absorbed, the first conveying roller 33 starts the rotation again at a first speed β (time t3). At this point, the pre-registration roller 17 is also rotated at the first speed β, whereby the sheet is conveyed at the conveying speed β in a distance C from the pre-registration position A to the registration roller 18 (registration sensor 42) as illustrated in FIG. 2.

When the sheet leading end is detected by the registration sensor 42 that is disposed in the neighborhood on the upstream side of the registration roller 18 (time t4), the rotation of the pre-registration roller 17 is stopped after a predetermined time elapses as illustrated in FIG. 2 (time t5). Then the pre-registration roller 17 starts the rotation at the same process speed α as the registration roller 18 after a predetermined time elapses (time t7) since the rotation of the registration roller 18 is started (time t6).

Through the operation, the sheet leading end reaches a nip portion of the registration roller 18 whose rotation is stopped, and the sheet is conveyed by the pre-registration roller 17 while the movement of the sheet leading end is blocked, thereby forming a predetermined loop to correct the skew feeding.

The pre-registration roller 17 is stopped at the time t5 of FIG. 2, and the registration roller 18 is immediately (sufficiently shorter than the maximum assumed time variation TT) rotated from the time t6 at the process speed α. Therefore, the loop formed in the sheet is eliminated, the pre-registration roller 17 is rotated from the time t7 at the process speed α, and the sheet is delivered to the image forming portion while the absence of the loop is maintained.

Conveyance control in continuously feeding the plurality of sheets will be described below. In cases where the plurality of sheets is continuously fed, the feeding of the next sheet is started after a predetermined time elapses since the rear end of the previous sheet passes through the separation roller 32.

The fed second sheet is conveyed through the fourth conveying roller 36 and the third conveying roller 35. When the second sheet reaches the sheet passing sensor 38, the control portion 23 performs control to temporarily stop the rotation of the second conveying roller 34 at a time t8 the sheet leading end reaches a predetermined position (second pre-registration position) D on the downstream side of the sheet passing sensor 38. That is, the second sheet is stopped at a pre-registration position that is adjacent to the pre-registration position of the first sheet on the upstream side of the pre-registration position of the first sheet. Therefore, the stop position of the sheet leading end is fixed to remove the variation in sheet leading end position in starting the feeding of the second sheet from the large-capacity sheet deck.

The second sheet reaches the registration roller 18 between a time t9 the rear end of the first sheet conveyed at the process speed α passes through the registration roller 18 and a time t10 a minimum sheet-to-sheet margin Tmin is obtained. Therefore, a time E ((distance F from second pre-registration position D to registration roller 18)/sheet conveying speed β) that is necessary for the second sheet to reach the registration roller 18 is computed. The second conveying roller 34 is rotated at a time t11 that is earlier than the time t10 by the time E in order to start the second sheet.

Because the second sheet is stopped at the pre-registration position on the upstream side of the first sheet, the conveyance of the second sheet can be started earlier than the first sheet. The sheet conveying speed β from the pre-registration position to the registration roller 18 is set faster the sheet conveying speed (process speed) α at which the image forming portion forms the image.

Therefore, compared with the case in which the second sheet is started from pre-registration position A similarly to the first sheet, the interval between the first and second sheets can easily be narrowed at the registration roller 18 without enhancing the sheet conveying speed β.

Then, as with the first sheet, the second sheet is conveyed by the pre-registration roller 17 while the leading end of the second sheet reaches a nip portion of the registration roller 18 whose rotation is stopped, thereby blocking the movement of the sheet leading end. Accordingly, the predetermined loop is formed to correct the skew feeding.

The pre-registration roller 17 is stopped at a time t12 of FIG. 2, and the registration roller 18 is immediately rotated from a time t13 at the process speed α, thereby eliminating the loop formed in the sheet. The pre-registration roller 17 is rotated from a time t14 at the process speed α, whereby the sheet is delivered to the image forming portion while the absence of the loop is maintained.

Feeding of a third sheet is started after a predetermined time elapses since the rear end of the second sheet passes through the separation roller 32. The fed third sheet passes through the fourth conveying roller 36. When the third sheet reaches the sheet passing sensor 41, the control portion 23 performs control to temporarily stop the rotation of the fourth conveying roller 36 at a time t15 the leading end of the third sheet reaches a predetermined position (third pre-registration position) G on the downstream side of the sheet passing sensor 41. That is, the control portion 23 stops the third sheet at the pre-registration position on the upstream side of the second pre-registration position D. Therefore, the stop position of the sheet leading end is fixed to eliminate the variation in sheet leading end position in starting the feeding of the third sheet from the large-capacity sheet deck.

The third sheet reaches the registration roller 18 between a time t16 the rear end of the second sheet conveyed at the process speed α passes through the registration roller 18 and a time t17 the minimum sheet-to-sheet margin Tmin is obtained. Therefore, a time H ((distance I from third pre-registration position G to registration roller 18)/sheet conveying speed β) that is necessary for the third sheet to reach the registration roller 18 is computed. The fourth conveying roller 36 is rotated at a time t18 that is earlier than the time t17 by the time H in order to start the third sheet.

Therefore, compared with the case in which the third sheet is started from pre-registration position D similarly to the second sheet, the interval between the second and third sheets can easily be narrowed at the registration roller 18 without enhancing the sheet conveying speed β.

Then, as with the first and second sheets, the third sheet is conveyed by the pre-registration roller 17 while the leading end of the third sheet reaches the nip portion of the registration roller 18 whose rotation is stopped, thereby blocking the movement of the sheet leading end. Accordingly, the predetermined loop is formed to correct the skew feeding. The pre-registration roller 17 is stopped at a time t19 of FIG. 2, and the registration roller 18 is immediately rotated from a time t20 at the process speed α, thereby eliminating the loop formed in the sheet. The pre-registration roller 17 is rotated from a time t21 at the process speed α, whereby the sheet is delivered to the image forming portion while the absence of the loop is maintained.

As with the first sheet, a fourth sheet is stopped at the pre-registration position A. Therefore, the feeding is started such that the leading end of the fourth sheet reaches the pre-registration position A (fastest case) between a time t22 the rear end of the third sheet passes through the pre-registration position A and a time t23 the minimum sheet-to-sheet margin Tmin is obtained. The control portion 23 performs control to temporarily stop the rotation of the first conveying roller 33 at a time t23 the sheet leading end reaches the pre-registration position A on the downstream side of the sheet passing sensor 37. Therefore, the stop position of the sheet leading end is fixed to eliminate the variation in sheet leading end position (maximum assumed time variation TT) in starting the feeding of the fourth sheet from the large-capacity sheet deck.

After a predetermined time TR (TT<TR) the maximum assumed time variation TT can sufficiently be absorbed, the first conveying roller 33 starts the rotation again at a first speed β (time t24), and the pre-registration roller 17 is also rotated at the first speed β, whereby the sheet is conveyed at the conveying speed β in the distance C from the pre-registration position A to the registration roller 18 (registration sensor 42) as illustrated in FIG. 2.

As with the first to third sheets, the sheet leading end reaches the nip portion of the registration roller 18 whose rotation is stopped, and the sheet is conveyed by the pre-registration roller 17 while the movement of the sheet leading end is blocked, thereby forming the predetermined loop to correct the skew feeding. The pre-registration roller 17 is stopped at a time t25 of FIG. 2, and the registration roller 18 is immediately rotated from the time t26 at the process speed α, thereby eliminating the loop formed in the sheet. The pre-registration roller 17 is rotated from a time t27 at the process speed α, and the sheet is delivered to the image forming portion while the absence of the loop is maintained.

Fifth and sixth sheets are controlled similarly to the second and third sheets, and the same control is performed every three sheets.

As described above, the plurality of pre-registration positions is disposed in the embodiment. Therefore, when the sheet is stopped at other times except for the time pre-registration position is located closest to the registration roller 18, the sheet interval can be shortened compared with the case in which the pre-registration position is located closest to the registration roller 18 (identical to the case in which only the pre-registration position A exists). The productivity can be improved even if the speed of the motor for driving the conveying rollers 33 to 36 is not enhanced.

In the embodiment, the time the sheet is conveyed from the pre-registration position is set such that the sheet interval at the registration roller 18 in changing the pre-registration position toward the upstream side in the sheet conveying direction is shorter than the sheet interval in changing the pre-registration position toward the downstream side in the sheet conveying direction.

(A4 Size)

Then the case of the A4 size (length of 210 mm) will be described with reference to FIG. 3.

The first sheet is fed similarly to the B5 size.

The feeding of the second sheet is started after a predetermined time elapses since the rear end of the first sheet passes through the separation roller 32. The fed second sheet passes through the fourth conveying roller 36. When the second sheet reaches the sheet passing sensor 39, the control portion 23 performs control to temporarily stop the rotation of the third conveying roller 35 at a time t28 the sheet leading end reaches the predetermined position (fourth pre-registration position) J on the downstream side of the sheet passing sensor 39. Therefore, the stop position of the sheet leading end is fixed to remove a variation in sheet leading end position (maximum assumed time variation TT) in starting the feeding of the second sheet from the large-capacity sheet deck.

The second sheet reaches the registration roller 18 between a time t29 the rear end of the first sheet conveyed at the process speed α passes through the registration roller 18 and a time t30 the minimum sheet-to-sheet margin Tmin is obtained. Therefore, a time K ((distance L from fourth pre-registration position J to registration roller 18)/sheet conveying speed β) that is necessary for the second sheet to reach the registration roller 18 is computed. The second sheet is started at a time t31 that is earlier than the time t30 by the time K.

As described above, because the second sheet is stopped at the pre-registration position on the upstream side of the first sheet, the conveyance of the second sheet can be started earlier than the first sheet. Therefore, compared with the case in which the second sheet is started from pre-registration position A similarly to the first sheet, the interval between the first and second sheets can easily be narrowed at the registration roller 18 without enhancing the sheet conveying speed β.

Then, as with the first sheet, the second sheet is conveyed by the pre-registration roller 17 while the leading end of the second sheet reaches the nip portion of the registration roller 18 whose rotation is stopped, thereby blocking the movement of the sheet leading end. Accordingly, the predetermined loop is formed to correct the skew feeding.

Figure 3:
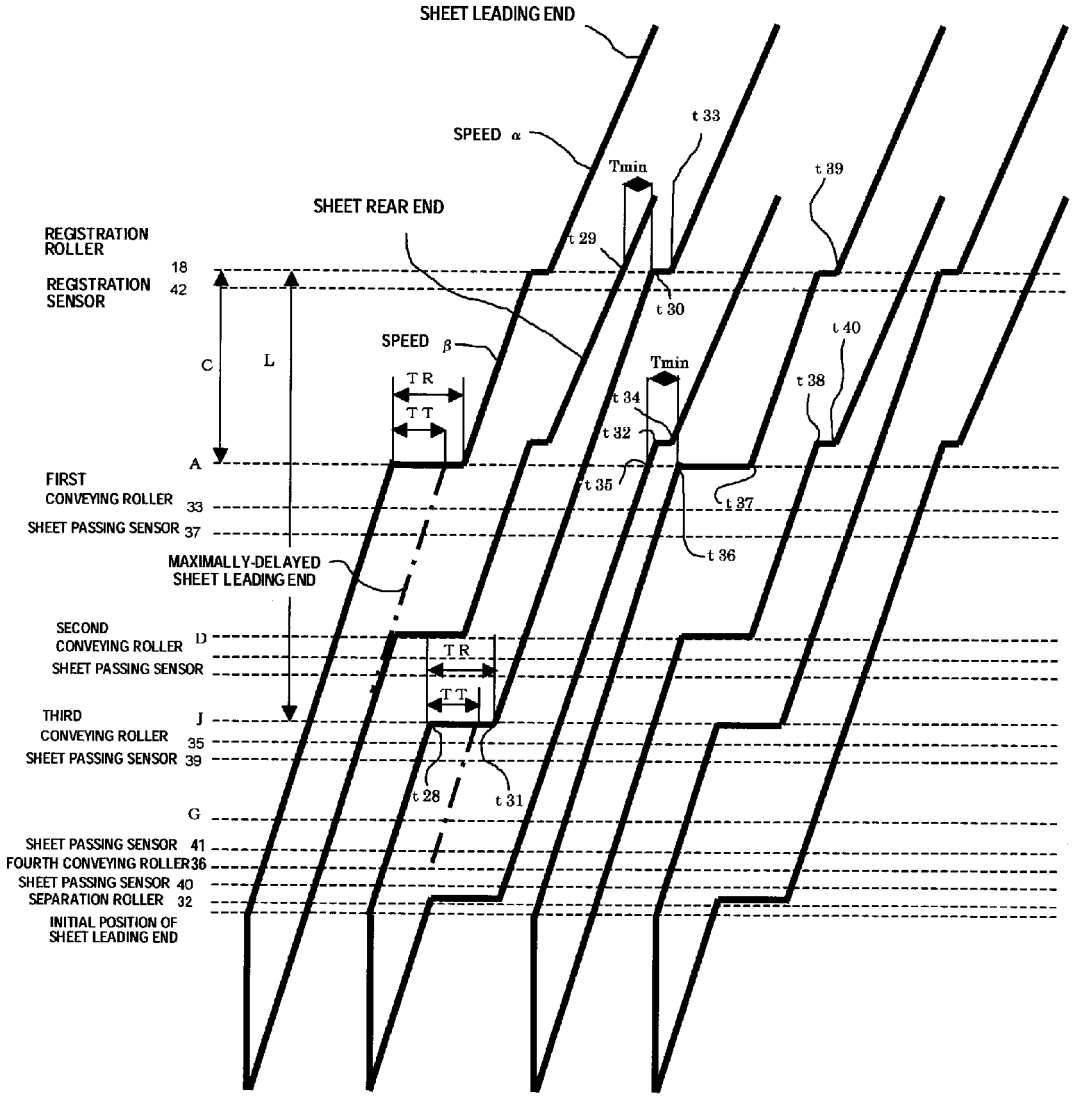
FIG. 3 is a diagram of A4-size sheet conveyance.

The pre-registration roller 17 is stopped at a time t32 of FIG. 3, and the registration roller 18 is immediately rotated from a time t33 at the process speed α, thereby eliminating the loop formed in the sheet. The pre-registration roller 17 is rotated from a time t34 at the process speed α, whereby the sheet is delivered to the image forming portion while the absence of the loop is maintained.

The third sheet is stopped at the pre-registration position A. Therefore, the feeding is started such that the leading end of the third sheet reaches the pre-registration position A (fastest case) between a time t35 the rear end of the second sheet passes through the pre-registration position A and a time t36 the minimum sheet-to-sheet margin Tmin is obtained.

The control portion 23 performs control to temporarily stop the rotation of the first conveying roller 33 at a time t36 the sheet leading end reaches the pre-registration position A on the downstream side of the sheet passing sensor 37. Therefore, the stop position of the sheet leading end is fixed to eliminate the variation in sheet leading end position (maximum assumed time variation TT) in starting the feeding of the third sheet from the large-capacity sheet deck.

After the predetermined time TR (TT<TR) the maximum assumed time variation TT can sufficiently be absorbed, the first conveying roller 33 starts the rotation again at the first speed β (time t37), and the pre-registration roller 17 is also rotated at the first speed β, whereby the sheet is conveyed at the conveying speed β in the distance C from the pre-registration position A to the registration roller 18 (registration sensor 42) as illustrated in FIG. 3.

As with the first and second sheets, the sheet leading end reaches the nip portion of the registration roller 18 whose rotation is stopped, and the sheet is conveyed by the pre-registration roller 17 while the movement of the sheet leading end is blocked, thereby forming the predetermined loop to correct the skew feeding. The pre-registration roller 17 is stopped at a time t38 of FIG. 3, and the registration roller 18 is immediately rotated from the time t39 at the process speed α, thereby eliminating the loop formed in the sheet. The pre-registration roller 17 is rotated from a time t40 at the process speed α, and the sheet is delivered to the image forming portion while the absence of the loop is maintained.

The fourth sheet is controlled similarly to the second sheet, and the same control is performed every two sheets.

As described above, in the case of the A4-size sheet, when the sheet is stopped at other times except for the time pre-registration position is located closest to the registration roller 18, the sheet interval can be shortened compared with the case in which the pre-registration position is located closest to the registration roller 18 (identical to the case in which only the pre-registration position A exists). The productivity can be improved even if the speed of the motor for driving the conveying rollers 33 to 36 is not enhanced.

(A3 Size)

Then the case of the A3 size (420 mm) will be described with reference to FIG. 4.

The first sheet is fed similarly to the B5 and A4 sizes.

The feeding of the second sheet is started after a predetermined time elapses since the rear end of the first sheet passes through the separation roller 32. The second sheet passes through the fourth conveying roller 36. When the second sheet reaches the sheet passing sensor 41, the control portion 23 performs control to temporarily stop the rotation of the fourth conveying roller 36 at a time t41 the sheet leading end reaches the predetermined position (third pre-registration position) G on the downstream side of the sheet passing sensor 41. Therefore, the stop position of the sheet leading end is fixed to remove the variation in sheet leading end position in starting the feeding of the second sheet from the large-capacity sheet deck.

The second sheet reaches the registration roller 18 between a time t42 the rear end of the first sheet conveyed at the process speed a passes through the registration roller 18 and a time t43 the minimum sheet-to-sheet margin Tmin is obtained. Therefore, the time H ((distance I from third pre-registration position G to registration roller 18)/sheet conveying speed β) that is necessary for the second sheet to reach the registration roller 18 is computed. The third sheet is started at a time t44 that is earlier than the time t43 by the time H.

At this point, the conveyance of the second sheet can be started earlier than the first sheet from the pre-registration position. Therefore, compared with the case in which the second sheet is started from pre-registration position A similarly to the first sheet, the interval between the first and second sheets can easily be narrowed at the registration roller 18 without enhancing the sheet conveying speed β.

Then, as with the first sheet, the second sheet is conveyed by the pre-registration roller 17 while the leading end of the second sheet reaches the nip portion of the registration roller 18 whose rotation is stopped, thereby blocking the movement of the sheet leading end. Accordingly, the predetermined loop is formed to correct the skew feeding. The pre-registration roller 17 is stopped at a time t45 of FIG. 4, and the registration roller 18 is immediately rotated from a time t46 at the process speed α, thereby eliminating the loop formed in the sheet. The pre-registration roller 17 is rotated from a time t47 at the process speed α, whereby the sheet is delivered to the image forming portion while the absence of the loop is maintained.

The third sheet is stopped at the pre-registration position A. Therefore, the feeding is started such that the leading end of the third sheet reaches the pre-registration position A (fastest case) between a time t48 the rear end of the second sheet passes through the pre-registration position A and a time t49 the minimum sheet-to-sheet margin Tmin is obtained. The control portion 23 performs control to temporarily stop the rotation of the first conveying roller 33 at the time t49 the sheet leading end reaches the pre-registration position A on the downstream side of the sheet passing sensor 37. Therefore, the stop position of the sheet leading end is fixed to eliminate the variation in sheet leading end position (maximum assumed time variation TT) in starting the feeding of the third sheet from the large-capacity sheet deck.

Figure 4:
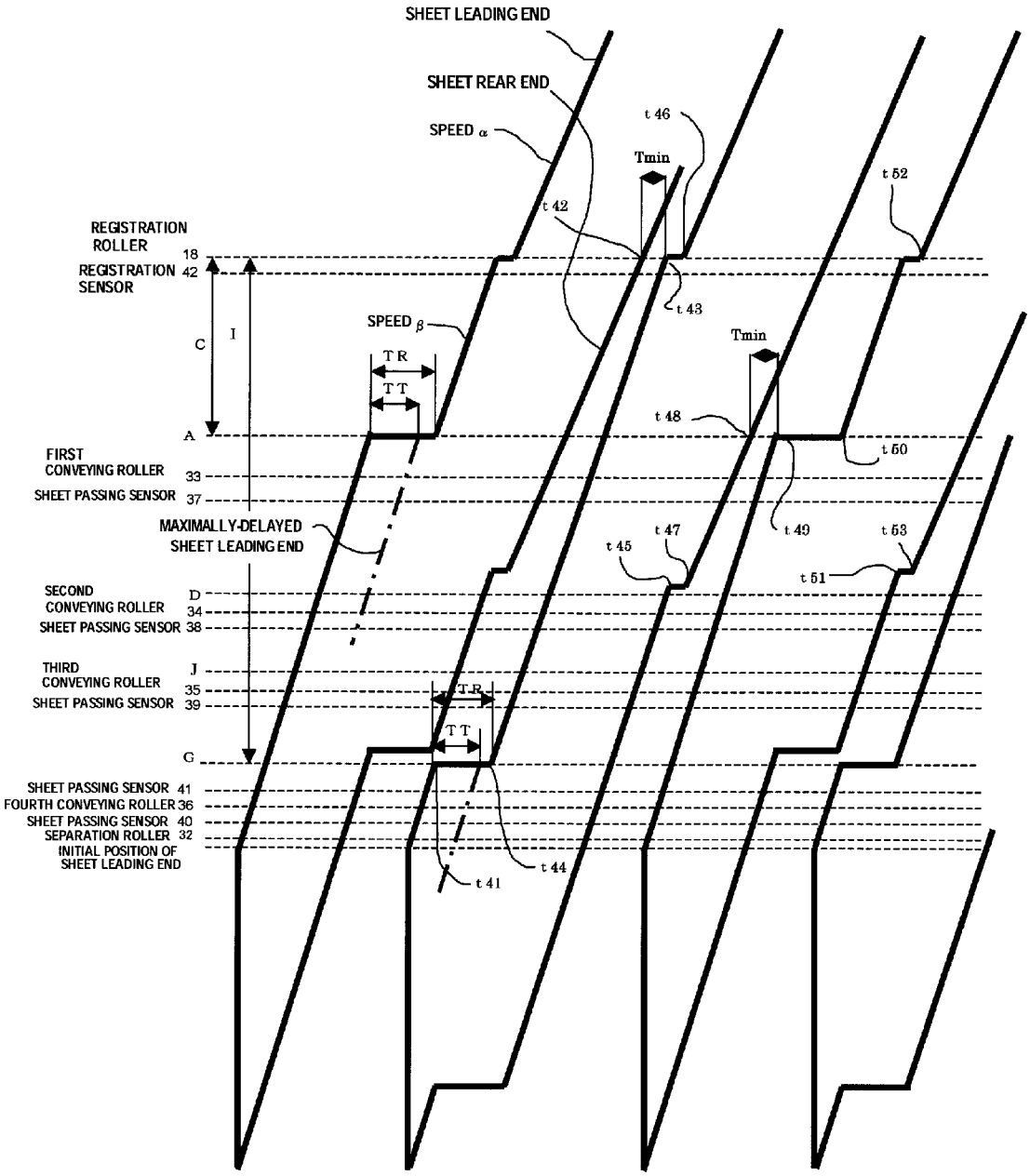
FIG. 4 is a diagram of A3-size sheet conveyance.
Figure 5:
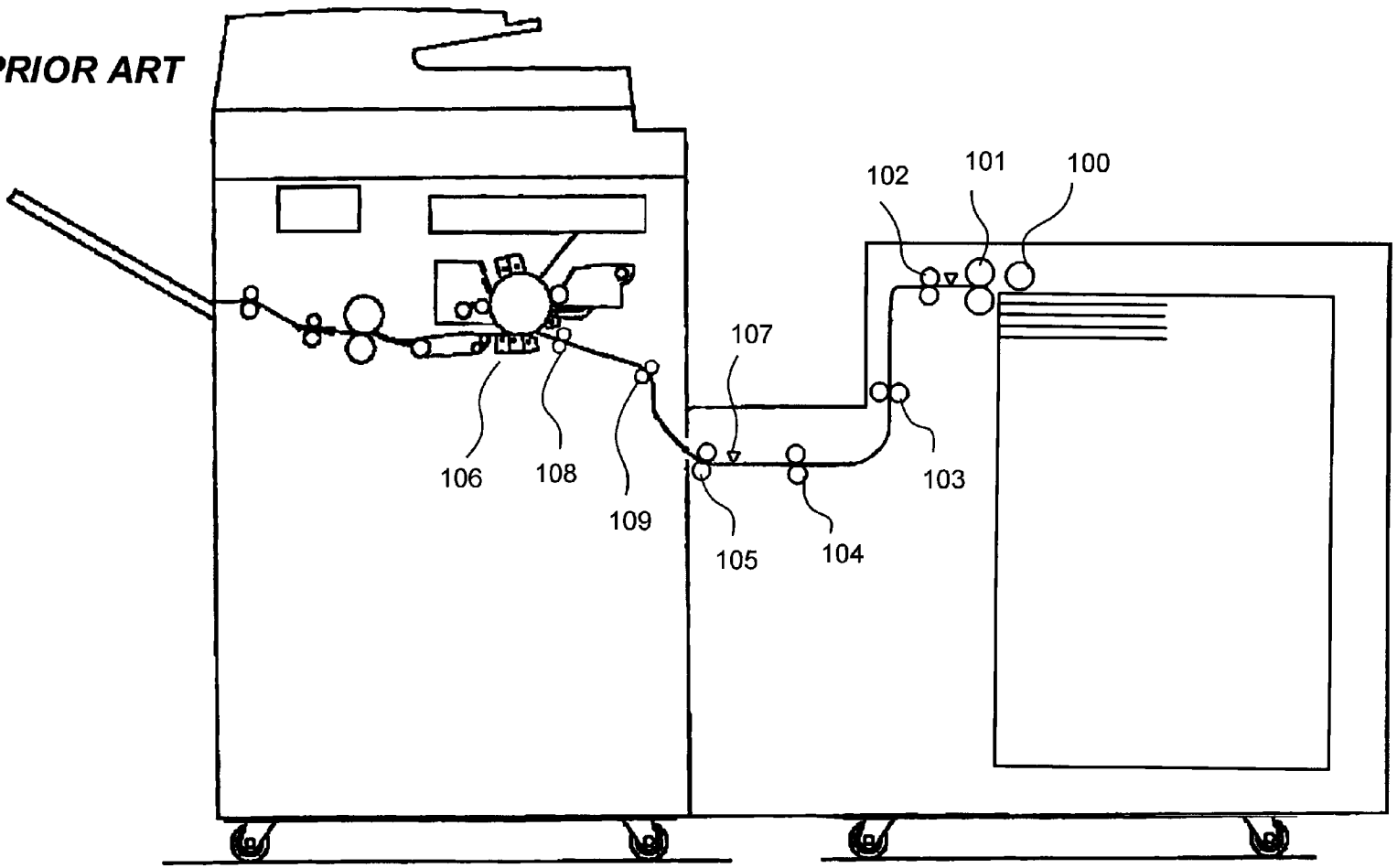
FIG. 5 PRIOR ART
FIG. 5 is an explanatory view illustrating a conventional configuration of sheet conveyance.
Figure 6:
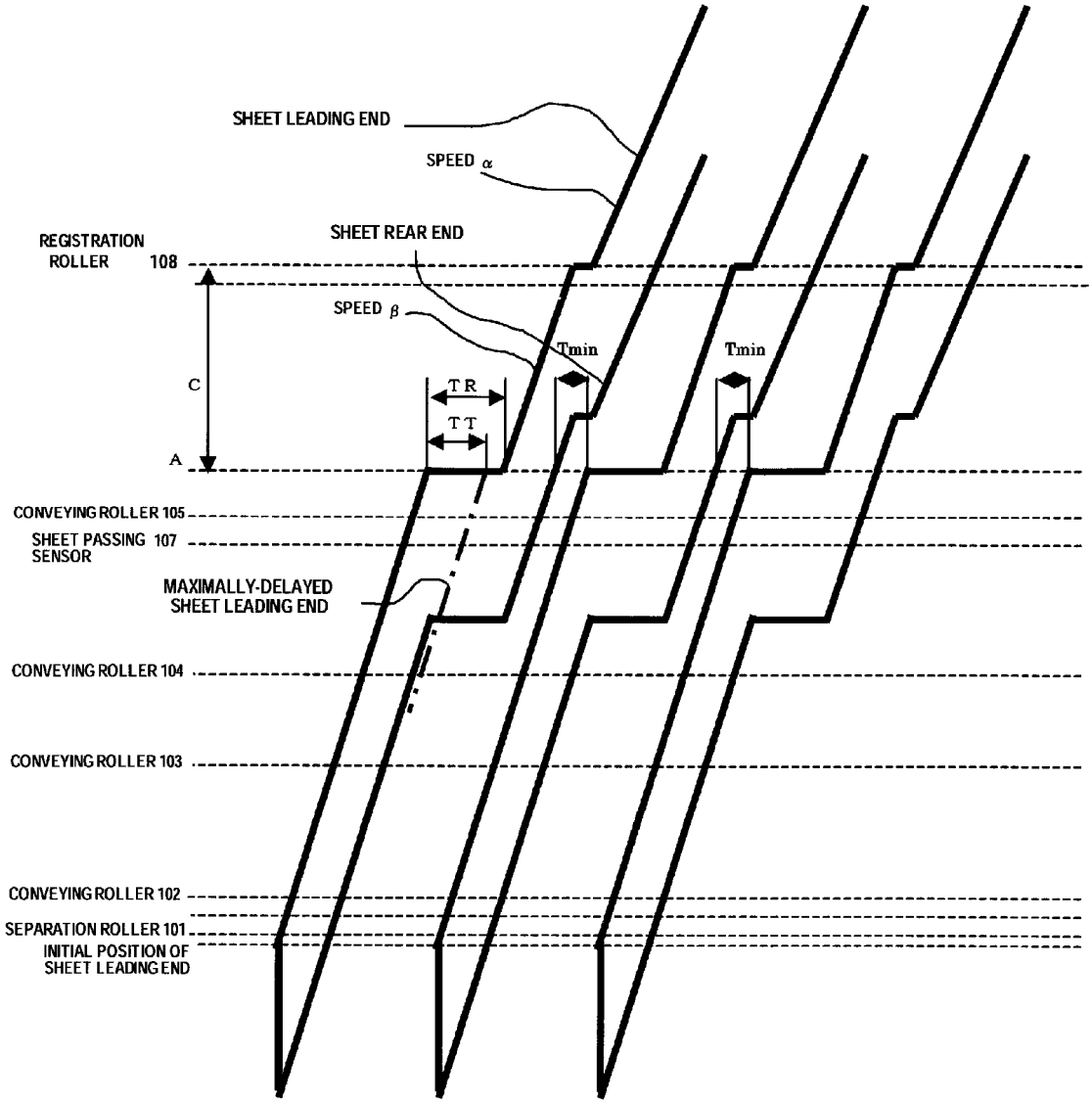
FIG. 6 PRIOR ART
FIG. 6 is a diagram of conventional sheet conveyance.
Figure 7:
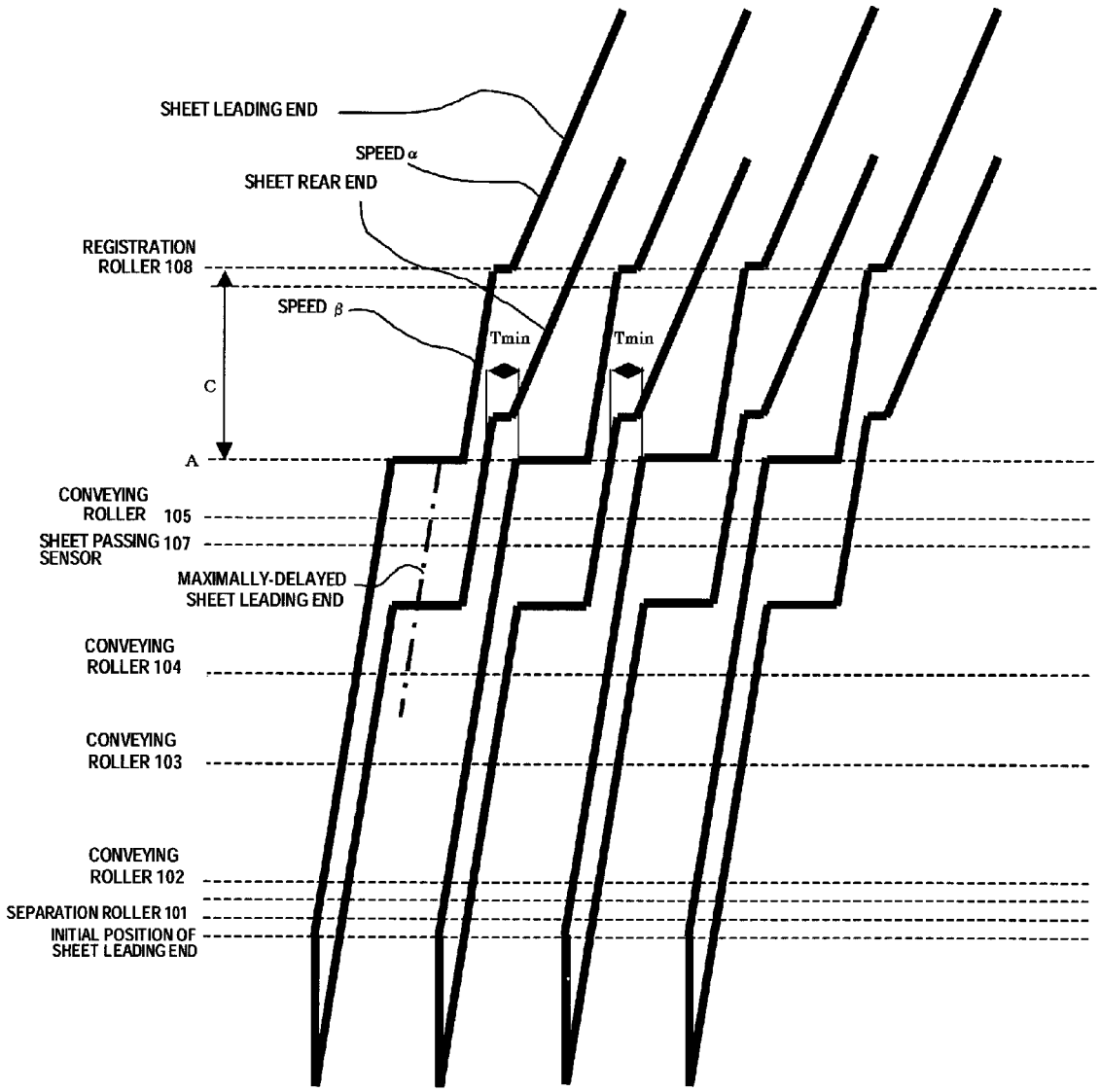
FIG. 7 PRIOR ART
FIG. 7 is a diagram of conventional sheet conveyance.

After the predetermined time TR (TT<TR) the maximum assumed time variation TT can sufficiently be absorbed, the first conveying roller 33 starts the rotation again at the first speed β (time t50), and the pre-registration roller 17 is also rotated at the first speed β, whereby the sheet is conveyed at the conveying speed β in the distance C from the pre-registration position A to the registration roller 18 (registration sensor 42) as illustrated in FIG. 4.

As with the first and second sheets, the sheet leading end reaches the nip portion of the registration roller 18 whose rotation is stopped, and the sheet is conveyed by the pre-registration roller 17 while the movement of the sheet leading end is blocked, thereby forming the predetermined loop to correct the skew feeding.

The pre-registration roller 17 is stopped at a time t51 of FIG. 4, and the registration roller 18 is immediately rotated from a time t52 at the process speed α, thereby eliminating the loop formed in the sheet. The pre-registration roller 17 is rotated from a time t53 at the process speed α, and the sheet is delivered to the image forming portion while the absence of the loop is maintained.

The fourth sheet is controlled similarly to the second sheet, and the same control is performed every two sheets.

As described above, in the case of A3-size sheet, when the sheet is stopped at other times except for the time pre-registration position is located closest to the registration roller 18, the sheet interval can be shortened compared with the case in which the pre-registration position is located closest to the registration roller 18 (identical to the case in which only the pre-registration position A exists).

In the embodiment, the sheet is fed to the image forming portion from the sheet feeding apparatus B that is separated from the image forming apparatus main body A. However, in cases where the sheet is fed to the image forming portion from the deck provided in the image forming apparatus main body, the same effect can be obtained by providing the plurality of pre-registration positions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-149465, filed Jun. 6, 2008, which is hereby incorporated by reference herein in its entirety.

What is claimed is:

1. An image forming apparatus comprising:

an image forming portion that forms an image on a sheet;

a registration portion that is disposed at an upstream side of the image forming portion relative to a sheet conveying direction to convey the sheet to the image forming portion in synchronization with an image forming operation; and a control portion that sets a plurality of stop positions on the upstream side of the registration portion, the sheet being stoppable at one of the plurality of stop positions, wherein the control portion controls conveying of the sheet toward the registration portion at a predetermined timing after the sheet is temporarily stopped at the one stop position, and wherein when the control portion controls conveying of a plurality of sheets continuously at the predetermined timing from any of the plurality of stop positions to the registration portion, the control portion controls to not stop continuously at an identical stop position.

2. The image forming apparatus according to claim 1, wherein, in continuously conveying the plurality of sheets, the timing of the sheets conveyed from any of the plurality of sheet stop positions is set such that a sheet interval in the registration portion in changing from one of the plurality of sheet stop positions toward the upstream side is shorter than a sheet interval in the registration portion in changing from one of the plurality of sheet stop positions toward a downstream side relative to the sheet conveying direction.

3. The image forming apparatus according to claim 1, wherein a sheet conveying speed from any of the plurality of stop positions to the registration portion is set faster than a sheet conveying speed at which the image forming portion forms the image.

4. The image forming apparatus according to claim 1, wherein the plurality of stop positions is selected according to a size of the conveyed sheet.

5. The image forming apparatus according to claim 2, wherein a sheet conveying speed from any of the plurality of stop positions to the registration portion is set faster than a sheet conveying speed at which the image forming portion forms the image.

* * * * *